US007784711B2

(12) United States Patent
Ricco et al.

(10) Patent No.: US 7,784,711 B2
(45) Date of Patent: Aug. 31, 2010

(54) METERING SERVOVALVE AND FUEL INJECTOR FOR AN INTERNAL COMBUSTION ENGINE

(75) Inventors: Mario Ricco, Casamassima (IT); Raffaele Ricco, Valenzano (IT); Sergio Stucchi, Valenzano (IT); Domenico Lepore, Valenzano (IT); Carlo Mazzarella, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 286 days.

(21) Appl. No.: 12/023,793

(22) Filed: Jan. 31, 2008

(65) Prior Publication Data

US 2009/0032621 A1 Feb. 5, 2009

(30) Foreign Application Priority Data

Jul. 30, 2007 (EP) ..... 07425481

(51) Int. Cl.
*F02M 47/00* (2006.01)

(52) U.S. Cl. ..... 239/96; 239/127; 239/585.1; 239/585.3; 239/DIG. 19; 123/467; 251/129.16

(58) Field of Classification Search ..... 239/88, 239/96, 124, 127, 585.1, 585.3, DIG. 19; 123/466–468; 251/129.16, 129.17, 129.19
See application file for complete search history.

(56) References Cited

U.S. PATENT DOCUMENTS

| | | | | |
|---|---|---|---|---|
| 5,088,647 | A * | 2/1992 | Yoshida et al. | 239/96 |
| 6,085,719 | A * | 7/2000 | Heinz et al. | 123/467 |
| 6,293,254 | B1 * | 9/2001 | Crofts et al. | 123/467 |
| 2006/0027684 | A1 * | 2/2006 | Ricco et al. | 239/585.1 |

(Continued)

FOREIGN PATENT DOCUMENTS

| | | | |
|---|---|---|---|
| DE | 4310984 | A | 10/1994 |

(Continued)

OTHER PUBLICATIONS

European Search Report.

*Primary Examiner*—Steven J Ganey
(74) *Attorney, Agent, or Firm*—The Belles Group, P.C.

(57) ABSTRACT

A fuel injector and servovalve for an internal combustion engine. In one embodiment, the fuel injector comprises a casing; a balanced metering servovalve in the casing that controls movement of an injection control rod along an axial cavity; said servovalve having; a valve body comprising a control chamber; an axial stem comprising a discharge channel having at least one radial segment that runs to a lateral surface of said axial stem; a calibrated inlet passage in communication with said control chamber; and an outlet passage in communication with said control chamber and the discharge channel; a sleeve having a shutter, said axial stem extending into said sleeve in a fluid tight manner and so that said sleeve that can axially slide along said axial stem between a closed position and an open position of said at least one radial segment, thereby controlling said movement of said injection control rod along said axial cavity; an electro-actuator having an armature that controls said axial sliding of said sleeve along said axial stem; an elastic member that exerts a force upon said armature that maintains said sleeve in said closed position, said electro-actuator being able to control said armature to overcome said force of said elastic member; and said armature being separate from said sleeve.

14 Claims, 2 Drawing Sheets

U.S. PATENT DOCUMENTS

2006/0032950 A1* 2/2006 Ricco et al. ..... 239/585.3
2006/0202145 A1* 9/2006 Ricco et al. ..... 251/129.16

FOREIGN PATENT DOCUMENTS

EP 0753658 A 1/1997
EP 1612403 A 1/2006
EP 1731752 A 12/2006

* cited by examiner

METERING SERVOVALVE AND FUEL INJECTOR FOR AN INTERNAL COMBUSTION ENGINE

CROSS-REFERENCE TO RELATED PATENT APPLICATIONS

The present application claims priority under 35 U.S.C. §119 to European Patent Application No. 07425481.4, filed Jul. 30, 2007, the entirety of which is hereby incorporated by reference.

FIELD OF THE INVENTION

The present invention generally relates to fuel injectors for internal combustion engines, and specifically to fuel injectors for internal combustion engines having a metering servovalve which controls an injection control rod.

BACKGROUND OF THE INVENTION

Normally, a metering servovalve comprises a control chamber having a calibrated inlet hole for pressurized fuel. The control chamber is equipped with an outlet or discharge hole having a calibrated section, which is opened/closed by an axially mobile shutter under the control of an electro-actuator.

Injectors with balanced metering servovalves have already been proposed in which the shutter is subject to substantially null axial pressure forces in the closed position, for which both the spring preload and the force of the actuator can be reduced. In a known balanced metering servovalve, the valve body comprises an axial guide for the armature of the actuator, which is integral with the shutter formed by a sleeve engaging with the axial guide in a fluid-tight manner. The latter is formed by a stem fitted with a discharge channel, comprising an axial segment and at least one calibrated radial segment, which runs to a lateral surface of the stem. As the sleeve must form a seal with the lateral surface of the stem and the shutter must close the discharge channel by engaging with a stop element, it must be machined with extreme precision and be made using a high-quality and very hard material. This material has limited magnetic permeability, and so the electro-actuator must be very powerful. In addition, because the armature is in the form of a notched disc and is integral with the sleeve, the entire sleeve-armature block must be made with this high-quality material for which a lot of waste swarf in this material is produced and machining is very difficult and expensive. Lastly, the armature and sleeve have considerable mass and so the responsiveness of the mobile element is reduced.

SUMMARY OF THE INVENTION

The object of the invention is that of embodying a fuel injector with balanced servovalve for an internal combustion engine, which is of simple and inexpensive manufacture and allows high servovalve responsiveness to be achieved, eliminating the above-mentioned drawbacks.

This object of the invention is achieved by a fuel injector with balanced metering servovalve, for an internal combustion engine, as defined in the attached claim.

In one aspect, the invention can be a fuel injector for an internal combustion engine comprising: a casing; a balanced metering servovalve in the casing that controls movement of an injection control rod along an axial cavity; said servovalve having; a valve body comprising a control chamber; an axial stem comprising a discharge channel having at least one radial segment that runs to a lateral surface of said axial stem; a calibrated inlet passage in communication with said control chamber; and an outlet passage in communication with said control chamber and the discharge channel; a sleeve having a shutter, said axial stem extending into said sleeve in a fluid tight manner and so that said sleeve that can axially slide along said axial stem between a closed position and an open position of said at least one radial segment, thereby controlling said movement of said injection control rod along said axial cavity; an electro-actuator having an armature that controls said axial sliding of said sleeve along said axial stem; an elastic member that exerts a force upon said armature that maintains said sleeve in said closed position, said electro-actuator being able to control said armature to overcome said force of said elastic member, and said armature being separate from said sleeve.

In another aspect, the invention can be a fuel injector for an internal combustion engine comprising: a casing; a servovalve in the casing that controls movement of an injection control rod along an axis; said servovalve having; a control chamber; a fuel inlet passage in communication with said control chamber; and an outlet passage in communication with said control chamber, said outlet passage terminating in at least one opening; a sleeve movable between a closed position where said at least one opening is sealed and an open position where said at least one opening is open, thereby controlling said movement of said injection control rod along said axis; an actuator having an armature that controls said movement of said sleeve; and said armature being non-unitary with respect to said sleeve.

In yet another aspect the invention can be a fuel injector with balanced metering servovalve, for an internal combustion engine, in which the servovalve controls an injection control rod, mobile along an axial cavity, said servovalve having a valve body comprising a control chamber fitted with a calibrated inlet for fuel and an outlet passage in communication with a discharge channel carried by an axial stem, a shutter carried by a sleeve that can move along said stem and is controlled by an armature of an electro-actuator, said channel comprising at least one substantially radial segment that runs to a lateral surface of said stem, said sleeve being normally coupled in a fluid-tight manner with said stem such that it can axially slide between a closed position and an open position of said segment to control the axial movement of said control rod, characterized in that said armature is separate from said sleeve and is able to keep said sleeve in said closed position by employing elastic means, said electro-actuator being able to control said armature to overcome the action of said elastic means.

In still another aspect, the invention can be a servovalve apparatus for controlling movement of an injection control rod in a fuel injector of an internal combustion engine, the servovalve comprising: a control chamber; a fuel inlet passage in communication with said control chamber; and an outlet passage in communication with said control chamber, said outlet passage terminating in at least one opening; a sleeve movable between a closed position where said at least one opening is sealed and an open position where said at least one opening is open, thereby controlling said movement of said injection control rod; an armature that controls said movement of said sleeve; and said armature being non-unitary with respect to said sleeve.

BRIEF DESCRIPTION OF THE DRAWINGS

For a better understanding of the invention, some preferred embodiments shall now be described, purely by way of non-limitative example, with the aid of the attached drawings, in which.

DETAILED DESCRIPTION OF THE DRAWINGS

Figure 1:
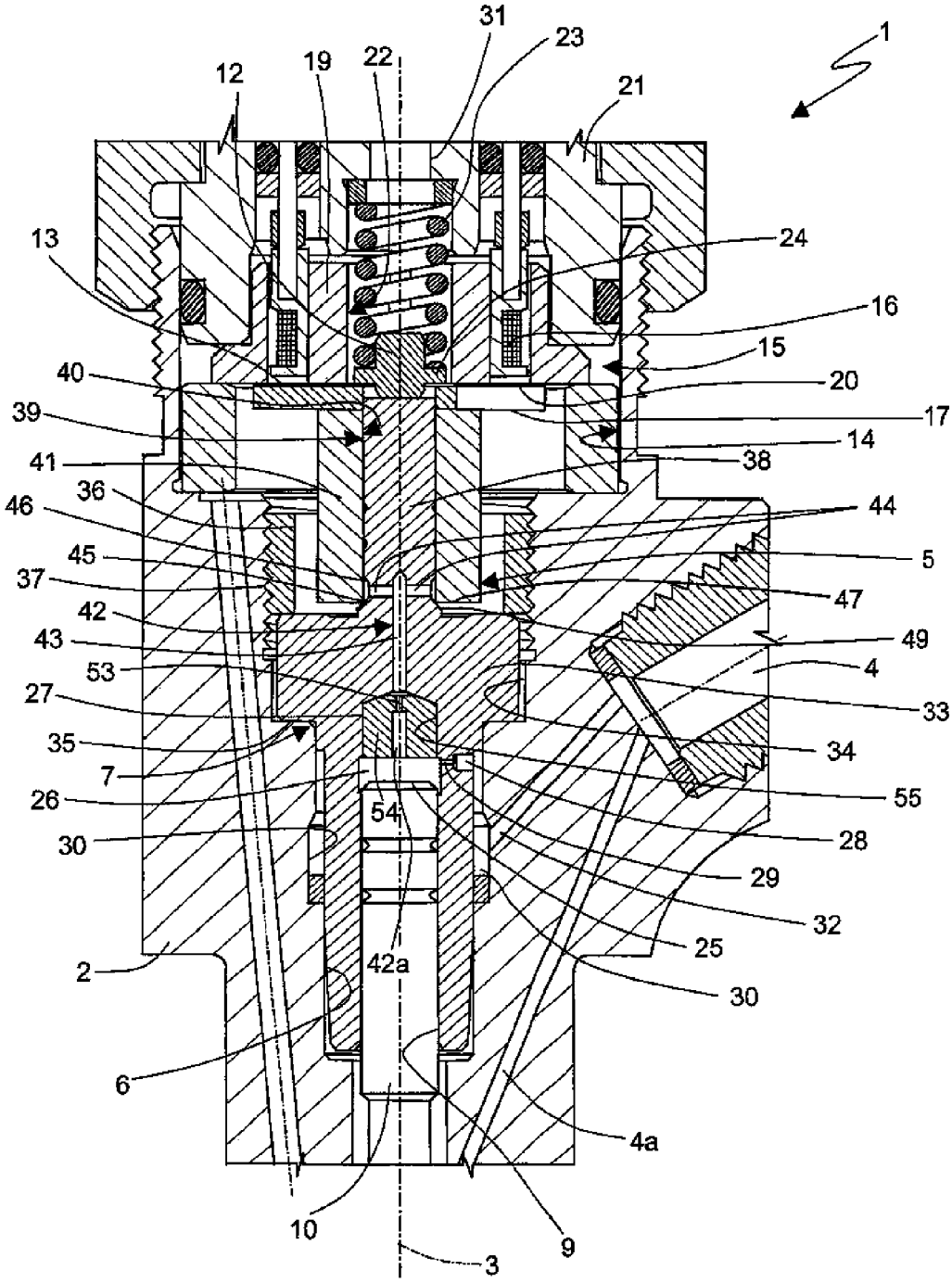
FIG. 1 is a partial, vertical cross-section of a fuel injector with a balanced servovalve, for an internal combustion engine, according to a first embodiment of the present invention.

With reference to FIG. 1, reference numeral 1 indicates, in its entirety, a fuel injector for an internal combustion engine, in particular a diesel-cycle one. The injector 1 comprises a hollow body or casing 2, which extends along a longitudinal axis 3, and has a side inlet 4 adapted to be connected to a high-pressure fuel feed, at a pressure of around 1800 bar for example. The casing 2 terminates in an injection nozzle (not visible in the figure), which is in communication with the inlet 4 through a channel 4*a*.

The casing 2 defines an axial cavity 6, which houses a metering servovalve 5 comprising a valve body, indicated with reference numeral 7. The valve body 7 defines an axial hole 9, in which an injection control rod 10 can slide axially, tightly sealed for fuel under pressure. The rod 10 is axially mobile in the hole 9 to control, in the known manner, a shutter needle (not shown) for the injection nozzle.

The casing 2 is provided with another cavity 14, coaxial with cavity 6 and housing an actuator 15, comprising an electromagnet 16 adapted to control an armature 17. In particular, the electromagnet 16 comprises a magnetic core 19, which has a stop surface 20 for the armature 17, perpendicular to axis 3, and is held in position by a support 21.

The actuator 15 has an axial cavity 22, in which a compression coil spring 23 is housed, so preloaded as to exert a thrust action on the armature 17, in the opposite direction to the attraction exerted by the electromagnet 16. The spring 23 acts on the armature 17 via a coaxial element formed by a flange 24, integral with a guide pin 12 of the spring 23. A sheet of non-magnetic material 13 is placed between the armature 17 and the flange 24 in order to ensure a certain gap between the armature 17 and the surface 20 of the core 19.

The valve body 7 comprises a metering control chamber 26, which includes the volume radially delimited by the lateral surface of the hole 9. Axially, the volume of the control chamber 26 is delimited by an end surface 25 of the rod 10 and by a bottom wall 27 of the hole 9 itself. The control chamber 26 permanently communicates with the inlet 4, through an inlet channel 28, to receive pressurized fuel.

The channel 28 is provided with a calibrated segment 29, which runs into the control chamber 26 close to the bottom wall 27, which is why the end surface 25 usefully has a truncated-cone shape. On the outside, the inlet channel 28 runs instead to an annular chamber 30, into which a channel 32, obtained in the body 2 and in communication with the inlet 4, also runs.

The valve body 7 also comprises a flange 33 housed in a portion 34 of the cavity 6 with increased diameter. The flange 33 is arranged axially in contact with an inner shoulder 35 of the cavity 6, as shall be better seen further on.

According to the invention, the armature 17 is axially guided by a guide element formed by an axial stem 38. In the variant in FIG. 1, the stem 38 is integral with the flange 33 that is held against an inner shoulder 35 of the cavity 6 of the body 2, in a fluid-tight manner, by a threaded ring 36 screwed into an internal thread 37 of portion 34. The stem 38 has a much smaller diameter than that of the flange 33 and projects beyond the flange 33 along axis 3 on the opposite side from the hole 9, i.e. towards the cavity 22. The stem 38 is externally delimited by a cylindrical lateral surface 39, which guides the axial sliding of a sleeve 41 associated with the armature 17. In particular, the sleeve 41 has a cylindrical inner surface 40, coupled to the lateral surface 39 of the stem 38 in a substantially fluid-tight manner, via coupling with suitable diametrical clearance, less than 4 micron for example, or via the insertion of specific sealing elements.

The control chamber 26 also has a fuel outlet passage 42*a*, having a restriction or calibrated section 53, which in general has a diameter between 150 and 300 micron. The outlet passage 42*a* is in communication with a channel 42 obtained entirely inside the flange 33 and the stem 38. The channel 42 comprises a blind axial segment 43, obtained along axis 3, partly in the flange 33 and partly in the stem 38. For technological reasons, the axial segment 43 of the channel 42 is instead at least four times the diameter of the calibrated section 53. The channel 42 also comprises at least one radial segment 44 in communication with the axial segment 43. In FIG. 1, two radial segments 44 are provided that run to an annular chamber 46 formed by a groove in the lateral surface 39 of the stem 38.

The annular chamber 46 is obtained in an axial position adjacent to the flange 33 and is opened/closed by a portion of the sleeve 41, which forms a shutter 47 for the radial segments 44 of the channel 42. The shutter 47 terminates with a sharp edge 45 adapted to engage a truncated-cone surface 49 connecting the flange 33 with the stem 38.

In particular, the armature 17 is formed by a notched disc separate from the sleeve 41. The disc 17 is obviously made of a magnetic material and can be obtained by simply shearing sheet metal. The sleeve 41 instead must be machined with extreme precision, for example, with a tolerance of around 1 micron, both to provide the seal against pressurized fuel along the lateral wall 39 of the stem 38, and to provide the fuel seal for the annular chamber 46 by means of the edge 45. To this end, the sleeve 41 is obtained using a very hard, high-quality material, for example tool steel. The inner surface 40 of the sleeve 41 is accurately ground and the sleeve 41 can possibly be subjected to one or more heat treatments, such as tempering and nitriding for example, to endow it with greater resistance to wear and fatigue.

The sleeve 41 is able to slide fluid-sealed on the stem 38 between an advanced end stop or closure position of the solenoid valve 5 and a retracted end stop or open position of the solenoid valve 5. In the advanced end stop position, the shutter 47 closes the annular chamber 46 and therefore also the outlet of the radial segments 44 of the channel 42. In the retracted end stop position, the shutter 47 sufficiently opens the annular chamber 46 to allow the radial segments 44 to discharge fuel from the control chamber 26, the outlet passage 42*a*, the discharge channel 42 and the annular chamber 46.

The advanced end stop position of the sleeve 41 is defined by the sharp edge 45 of the shutter 47 hitting against the truncated-cone surface 49 of the stem 38. Instead, the retracted end stop position of the sleeve 48 is defined by the armature 17 axially hitting against the surface 20 of the core 19, with the thin sheet 13 inserted in between. In the retracted end stop position, the sleeve 41 places the annular chamber 46 in communication with a discharge channel of the injector, via an annular passage between the threaded ring 36 and the sleeve 41, the notches in the armature 17, the cavity 22 and an opening 31 in the support 21.

When the shutter 47 is in the advanced end stop position and provides sealing, a pressure level is established in the annular chamber 46 equal to the supply pressure of the injector. As a result of this pressure, there is a radial elastic deformation of the portion of the shutter 47 and, with respect to the situation where the pressure in the chamber 46 is equal to atmospheric pressure, there is a slight increase in the diameter of the seal edge 45.

This increase in diameter causes a slight unbalance in the resultant of the pressure forces acting along the axial direction of the sleeve 41. This resultant, defined by the pressure in the chamber 46 multiplied by the annular area contained between the diameter of the edge 45 and the diameter of the cylindrical surface 40 of the sleeve, tends to lift the shutter 47. However, while this unbalancing force is less than the force exerted by the spring 23, the sleeve 41 remains in the advanced end stop position. When the magnet 16 is energized, the armature 17 moves towards the core 19, overcoming the action of the spring 23, and in consequence, the axial resultant of the pressure forces acting on the sleeve 41 moves this sleeve to the retracted end stop, hitting against the armature 17, and hence the shutter 47 opens the annular chamber 46. Fuel is then discharged from the control chamber 26, the channel 42 and the annular chamber 46 itself. The fuel pressure in the control chamber 26 rapidly drops, causing an upward axial movement of the rod 10 and thus the opening of the injection nozzle.

Conversely, on de-energizing the electromagnet 16, the spring 23, via the flange 24, causes the armature 17 to move away from the core 19, dragging the sleeve 41 with it. This now returns the shutter 47 to the advanced end stop position of FIG. 1. In this way, the annular chamber 46 is closed again and fuel entering from the inlet channel 28 re-establishes high pressure in the control chamber 26, resulting in the rod 10 closing the injection nozzle again.

In order to make the metering servovalve 5 more responsive, the calibrated section 53 is arranged in the outlet passage 42*a* away from the annular chamber 46 and hence the shutter 47, and substantially close to the surface of the bottom wall 27 of the hole 9. In this way, the volume of fuel for which the pressure variation must be controlled is significantly reduced. Instead, the volume of fuel in the channel 42 downstream of the calibrated section 53 does not substantially affect the pressure variation in the control chamber 26.

For technological reasons, the calibrated section 53 should preferably be arranged in a separate element of the valve body 7. In FIG. 1, the separate element is formed by a bushing 54 of a very hard material, which carries the outlet passage 42*a*, including the calibrated section 53, and is subsequently fixed in a seat 55 in correspondence to the bottom wall 27 of the hole 9, such that the control chamber 26 is defined by the transverse surface of the bushing 54. The calibrated section 53 can be obtained with great precision, for example, by an initial machining carried out via electron discharge or laser and then with the effective calibration achieved via hydroerosion.

The calibrated section 53 is only limited to part of the axial length of the bushing 54, while along the remaining length of the bushing 54 the outlet passage 42*a* can have a diameter substantially smaller or equal to that of the axial segment 43. In any case, both the axial segment 43 and the radial segment 44 of the channel 42 are obtained in the flange 33*e* of the stem 38 via normal drill bits, or laser or even electron discharge, but without any special machining precision.

From what has been seen above, the advantages of the injector 1 according to the invention with respect to injectors of known art are evident. First of all, the armature 17 separated from the guide sleeve 41 allows the material of the armature 17 to be optimized so as to optimize the electromagnetic circuit and allows a high-quality material with high wear resistance to be chosen for the sleeve 41, in this way avoiding the drawback of also having to machine the disc of the armature 17 in this material, with considerable material wastage in swarf. Manufacturing the armature 17 itself in a less hard material thus becomes much simpler. Lastly, the mass of the mobile element that the electromagnet 16 and the spring 23 must move is reduced.

Figure 2:
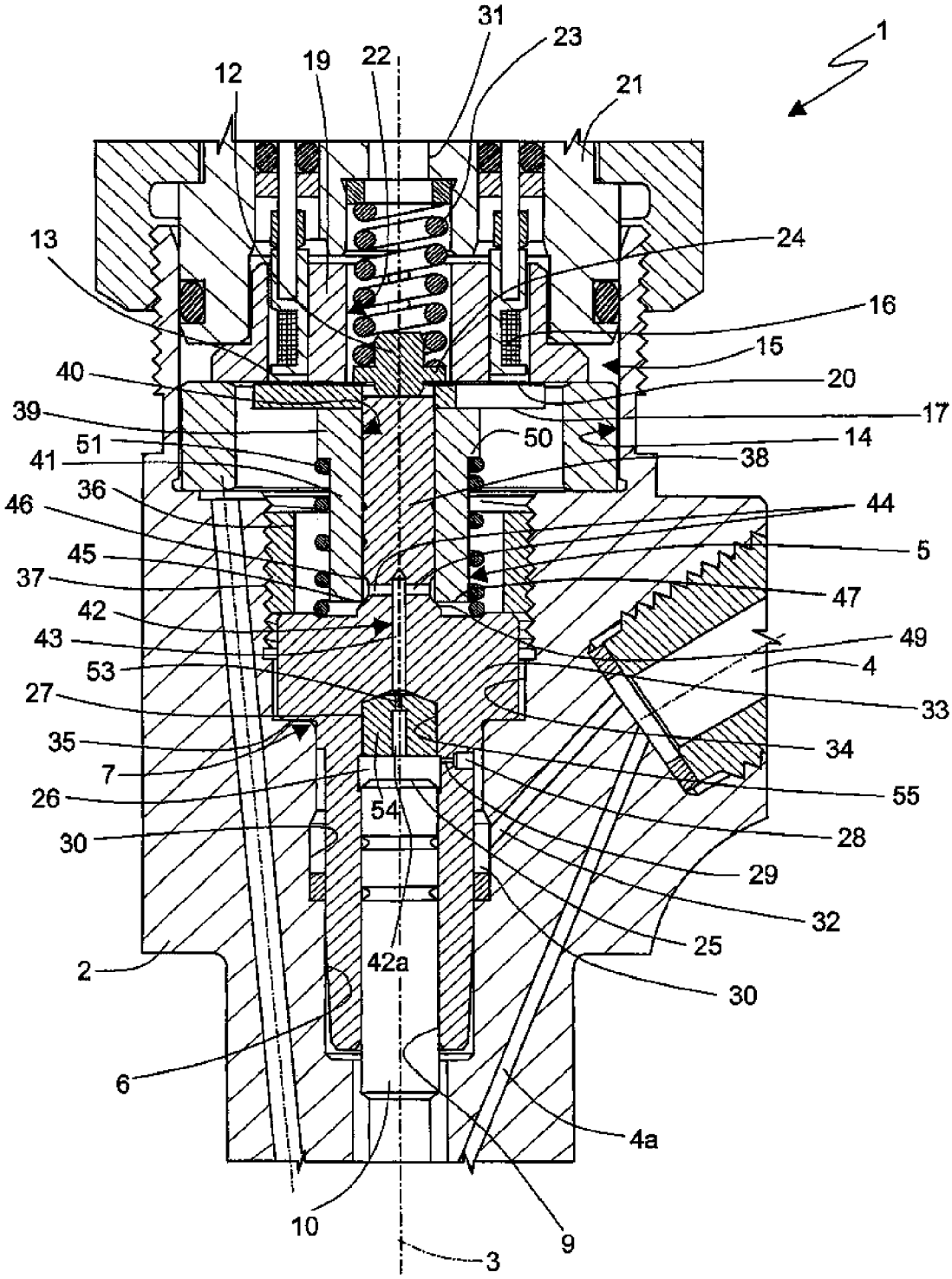
FIG. 2 is a vertical cross-section of a fuel injector with a balanced servovalve, for an internal combustion engine, according to a second embodiment of the present invention.

In order to reduce the opening times of the shutter 47, especially when the injector 47 is fed at low pressure, according to the variant in FIG. 2 a spring 51 can be inserted between a shoulder 50 of the sleeve 41 and the flange 33 of the valve body 7. The spring 51 shall be preloaded so as to exert a much smaller force than that exerted by spring 23 and only sufficient to ensure more rapid opening of the shutter 47 when the armature 17 is attracted towards the core 19.

It is clear that other modifications and improvements can be made to the injector 1 without leaving the scope of the invention. For example, the support 54 can be removed, or assume a different shape from those shown. Furthermore, the radial segments 44 of the channel 42 can be more than two in number and be arranged angularly equidistant and/or inclined with respect to axis 3. In turn, the calibrated section 53 can be arranged on the radial segments 44 of the channel 42. The valve body 7 can be subdivided into two parts, one containing the stem 38 and part of the flange 33, and the other containing the remaining portion of the flange 33 and the hole 9. Lastly, the electromagnet 16 can be substituted by a piezoelectric actuator device.

Of course, other variations of the invention exist and any of the specific structures discussed above can be combined and/or omitted in a multitude of combinations. The true scope of the invention must be determined by the claims. While the invention has been described and illustrated in sufficient detail that those skilled in this art can readily make and use it, various alternatives, modifications, and improvements should become readily apparent without departing from the spirit and scope of the invention.

What is claimed is:

1. A fuel injector for an internal combustion engine comprising:

a casing;

a balanced metering servovalve in the casing that controls movement of an injection control rod along an axial cavity;

said servovalve having;

a valve body comprising a control chamber;

an axial stem comprising a discharge channel having at least one radial segment that runs to a lateral surface of said axial stem;

a calibrated inlet passage in communication with said control chamber; and an outlet passage in communication with said control chamber and the discharge channel;

a sleeve having a shutter, said axial stem extending into said sleeve in a fluid tight manner so that said sleeve can axially slide along said axial stem between a closed position and an open position of said at least one radial segment, thereby controlling said movement of said injection control rod along said axial cavity;

an electro-actuator having an armature that controls said axial sliding of said sleeve along said axial stem;

an elastic member that exerts a force upon said armature that maintains said sleeve in said closed position, said electro-actuator being able to control said armature to overcome said force of said elastic member; and said armature being separate from said sleeve.

2. The fuel injector of claim 1 wherein said axial stem is carried by a flange, said shutter being formed by an end portion of said sleeve and having a sharp edge that engages a truncated-cone portion between said flange and said axial stem when said sleeve is in said closed position.

3. The fuel injector of claim 2 wherein said at least one radial segment runs to an annular chamber formed by a groove in said lateral surface of said stem, and wherein fuel pressure in said annular chamber generates an axial force able to keep said sleeve in contact with said armature.

4. The fuel injector of claim 2 further comprising:

wherein said at least one radial segment runs to an annular chamber formed by a groove in said lateral surface of said stem; and means for keeping said sleeve in contact with said armature.

5. The fuel injector of claim 4 wherein said means for keeping said sleeve in contact with said armature comprises an elastic element exerting a force on said sleeve toward said armature that is less than the force exerted by said elastic member on said armature.

6. The fuel injector of claim 1 wherein said outlet passage has a calibrated portion.

7. The fuel injector of claim 1 further comprising:

said valve body comprising a seat; and a bushing positioned in said seat, said outlet passage located within said bushing.

8. The fuel injector of claim 1 wherein said valve body comprises a flange and said discharge channel runs through the flange, said valve body being fixed in a sealed manner in a cavity of the casing via a threaded ring.

9. The fuel injector of claim 1 wherein said armature is made of a magnetic material and said sleeve is made of a hard material suitable for being machined with extreme precision.

10. The fuel injector of claim 9 wherein said hard material is suitable for heat treatment to give it greater wear and fatigue resistance.

11. The fuel injector of claim 9 wherein an inner surface of said sleeve is machined with a tolerance of around one micron.

12. The fuel injector of claim 1 wherein said armature is non-unitary with respect to said sleeve, said armature made of a first material and said sleeve is constructed of a second material.

13. The fuel injector of claim 1 wherein said armature is made of a first material and said sleeve is made of a second material.

14. The fuel injector of claim 13 wherein said first material is a magnetic material and said second material is a heat treated steel.

* * * * *